United States Patent [19]

Kinghorn et al.

[11] Patent Number: 4,989,384

[45] Date of Patent: Feb. 5, 1991

[54] INSULATED WINDOW ASSEMBLY WITH INTERNAL MUNTIN BARS

[75] Inventors: James J. Kinghorn; Mark J. Hunke, both of Pella, Iowa

[73] Assignee: Rolscreen Company, Pella, Iowa

[21] Appl. No.: 459,973

[22] Filed: Jan. 2, 1990

[51] Int. Cl.[5] ..... E06B 3/70

[52] U.S. Cl. ..... 52/456; 52/171; 52/788; 52/790

[58] Field of Search ..... 52/788, 789, 790, 456, 52/455, 656, 665, 668, 311

[56] References Cited

U.S. PATENT DOCUMENTS

| | | | |
|---|---|---|---|
| 943,801 | 12/1909 | Watson | 52/476 |
| 998,620 | 7/1911 | Leonard . | |
| 1,092,727 | 4/1914 | Linder . | |
| 2,029,541 | 2/1936 | Martinson | 52/202 |
| 2,167,772 | 8/1939 | Owen | 20/56.4 |
| 2,408,281 | 9/1946 | Wilkin | 20/56.3 |
| 2,612,662 | 10/1952 | Pfaff | 52/400 |
| 2,670,507 | 3/1954 | Daitch | 52/202 |
| 2,848,762 | 8/1958 | Peterson | 20/56.4 |
| 3,212,179 | 10/1965 | Koblensky | 29/451 |
| 3,293,817 | 12/1966 | MacGregor | 52/456 |
| 3,308,593 | 3/1967 | Smith | 52/790 X |
| 3,504,468 | 4/1970 | Martin | 52/456 |
| 3,791,095 | 2/1974 | Martin | 52/758 |
| 3,918,202 | 11/1975 | Smith | 52/456 |
| 3,946,531 | 3/1976 | Armstrong | 52/456 |
| 4,368,226 | 1/1983 | Mucaria | 428/34 |
| 4,438,165 | 3/1984 | Butler | 428/38 |
| 4,598,520 | 7/1986 | Ellstrom | 52/456 |
| 4,652,472 | 3/1987 | Davies | 428/34 |
| 4,723,388 | 2/1988 | Zieg | 52/456 X |
| 4,783,938 | 11/1988 | Palmer | 52/171 |

FOREIGN PATENT DOCUMENTS

| | | |
|---|---|---|
| 2637034 | 2/1978 | Fed. Rep. of Germany . |
| 7924256 | 11/1979 | Fed. Rep. of Germany . |
| 3403133 | 5/1985 | Fed. Rep. of Germany . |
| 2185516 | 7/1987 | United Kingdom . |

*Primary Examiner*—Richard E. Chilcot, Jr.
*Assistant Examiner*—Creighton Smith
*Attorney, Agent, or Firm*—Zarley, McKee, Thomte, Voorhees, & Sease

[57] ABSTRACT

The internal muntin bars of an insulated window assembly include spaced apart component bars. Each component bar extends between opposite sides of the perimeter bar and has cooperating notches for engagement with the adjacent component bar which crosses it. A telescoping fastener with disc-like heads is received in a center opening at the intersection of crossing muntin bars and serves to lock the bars together and fill the space between the glass panes. The legs of a U-shaped retainer are received in the open ends of the component bars and are secured to the perimeter bar.

17 Claims, 4 Drawing Sheets

INSULATED WINDOW ASSEMBLY WITH INTERNAL MUNTIN BARS

BACKGROUND OF THE INVENTION

An insulated window having spaced apart panes of glass giving the appearance of a true divided lite is desirable. This kind of window is represented in the Palmer Pat. No. 4,783,938 wherein an internal grid of muntin bars is positioned between the spaced apart panes of glass. The muntin bars are formed from a single member extending from a perimeter bar to a connector at an intersection of a plurality of individual muntin bars.

It is desirable to have flexibility in selecting the apparent effective width of the internal muntin bar and be able to do so at a minimum cost for materials and assembly.

SUMMARY OF THE INVENTION

An internal muntin bar grid is provided wherein each bar in the grid includes a pair of spaced apart component bars which extend between opposite sides of the perimeter bar of the window assembly. The component bars are notched to cooperatively register with component bars which cross. The notches on the pair of component bars may face in the same direction and in the direction opposite to those of component bars registering therewith or the notches may extend in opposite directions on a pair of component bars, but still in opposite directions from the component bars registering therewith. The component bars have the same cross section as the perimeter bar.

The apparent width of the internal muntin bar may be readily varied by spacing the component bars as appropriate to give the desired width appearance. The space between the component bars is not visible since an external muntin bar is provided on the outside face of the adjacent pane of glass.

A plastic telescoping fastener locks the intersecting two pairs of component bars together by being placed in a rectangular opening formed at the center of the intersection. The shape of the connector is rectangular and substantially fills the opening. The connector has disc like heads which fill the space between the panes of glass and the internal muntin bars.

The component muntin bars are open ended and receive legs of a U-shape retainer which connects them to the perimeter bar. The legs of the retainer have outwardly and rearwardly extending arms which frictionally engage the adjacent wall of the component bar opening to provide a tight fit and connection to the perimeter bar.

DESCRIPTION OF THE PREFERRED EMBODIMENT

Figure 1:
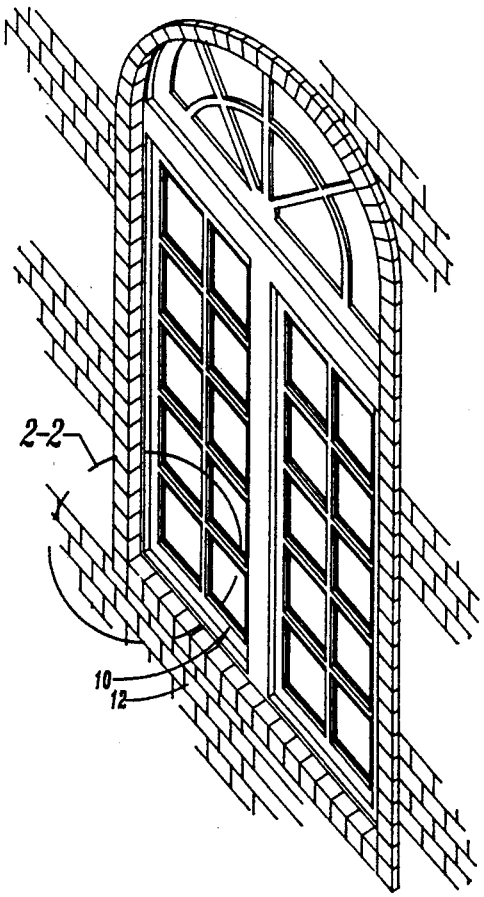
FIG. 1 is fragmentary perspective view of a window assembly including the internal muntin bar grid of this invention.

The insulated window assembly of this invention is referred to generally in FIG. 1 by the reference numeral 10 and is shown in the wall 12 of a building.

Figure 2:
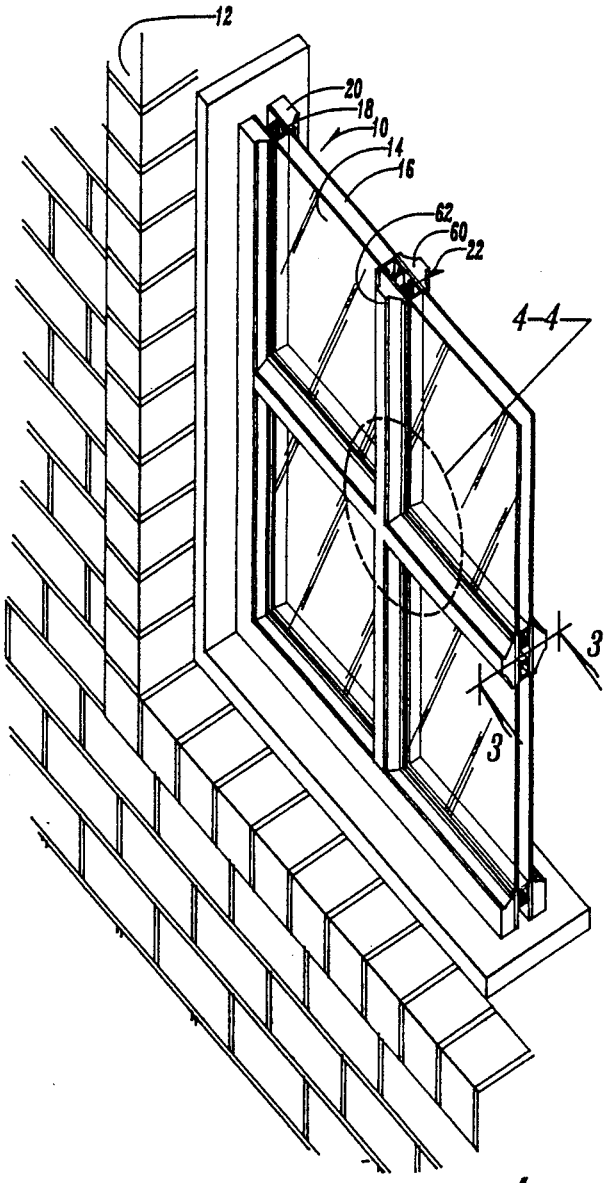
FIG. 2 is an enlarged fragmentary perspective view of the detail 2—2 in FIG. 1.
Figure 3:
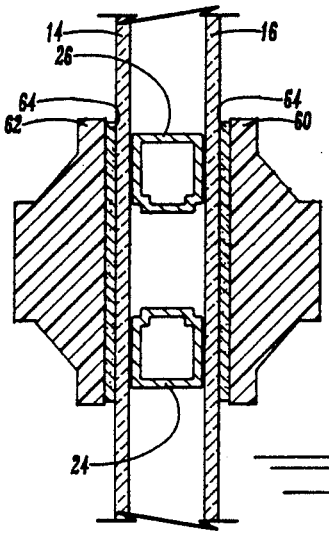
FIG. 3 is a cross sectional view taken along line 3—3 in FIG. 2.

The window assembly 10 is shown in greater detail in FIG. 2 and includes spaced apart panes of glass 14 and 16, interconnected and sealed by a perimeter bar 18 received in a window frame 20.

Figure 4:
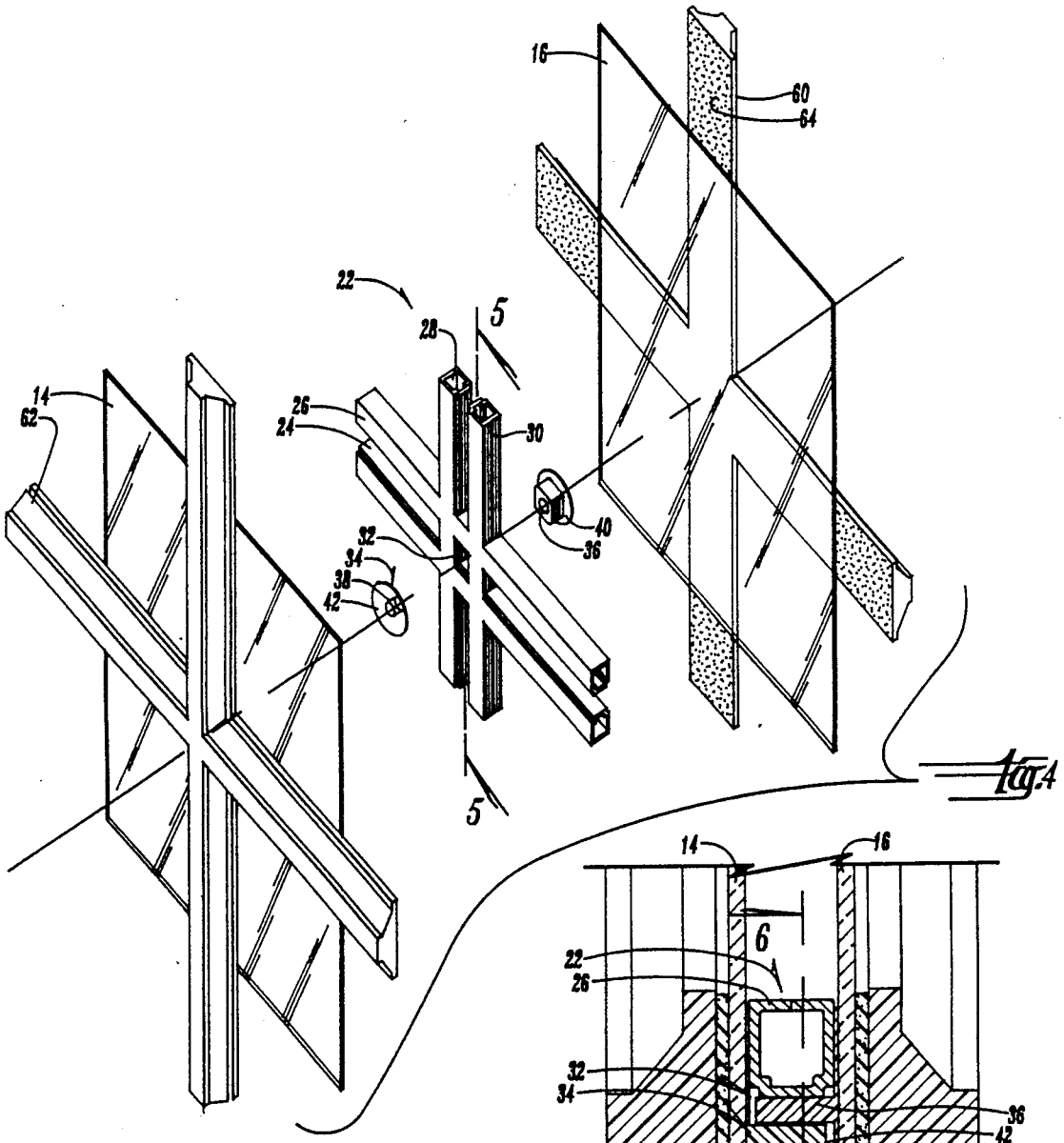
FIG. 4 is an exploded fragmentary perspective view of the detail 4—4 in FIG. 2.

As seen in FIG. 4, an internal muntin bar grid assembly 22 is provided which comprises two pairs of component bars 24, 26 and 28, 30. A center rectangular in shape opening 32 is formed which receives a telescoping fastener 34 which locks the component bars together. The fastener 34 includes telescoping portions 36, 38 with the portion 36 being rectangular in shape, substantially filling the opening 32. The portion 38 is cylindrical in shape and is received in the rectangular axial opening of the member 36. A disc like head 40 is provided on the member 36, while a comparable disc head 42 is provided on the member 38. The disc heads 40 and 42 function to hold the component bars together and also the space the panes 14 and 16 apart such that they will not engage the component muntin bars. The spacing between the panes 14 and 16 is greater than the thickness of the component muntin bars and thus ordinarily will not touch the muntin bars. The spacer head discs 40 and 42 may not be needed as spacers, but in the event temperature conditions are such the glass panes may be deformed sufficiently to otherwise contact the muntin bars, contact will be prevented.

Figure 14:
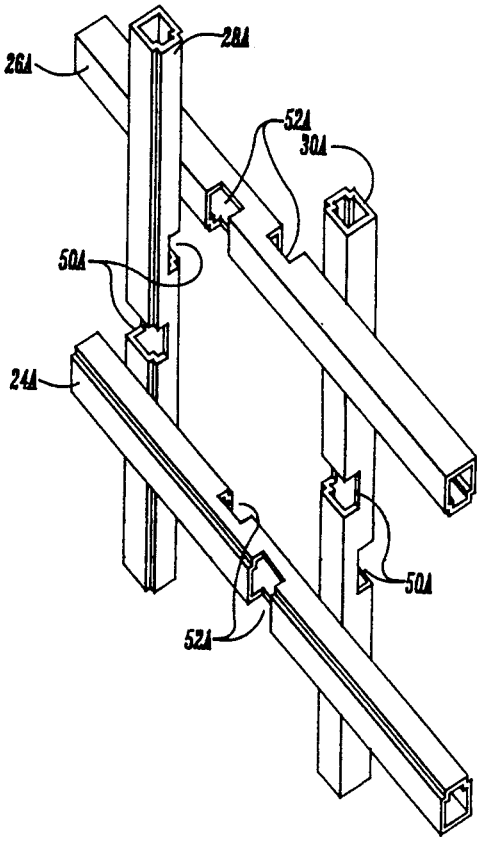
FIG. 14 a view similar to FIG. 13 but showing an alternate embodiment.

The pair of component muntin bars 24 and 26 each include a pair of notches 50 which register with corresponding notches 52 in intersecting component muntin bars 28 and 30. The notches 50 face in the same direction but in a direction opposite from the notches 52. In FIG. 14, an alternate embodiment of the notch arrangement is shown wherein notches 50A in bars 24A and 26A face in opposite directions as do notches 52A on bars 28A and 30A.

Figure 11:
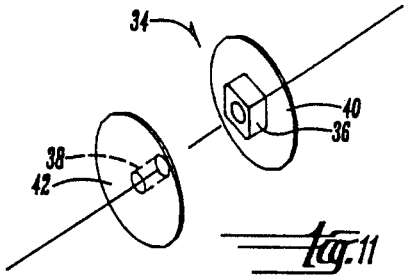
FIG. 11 is an exploded perspective view of the fastener interconnecting the component muntin bars.
Figure 12:
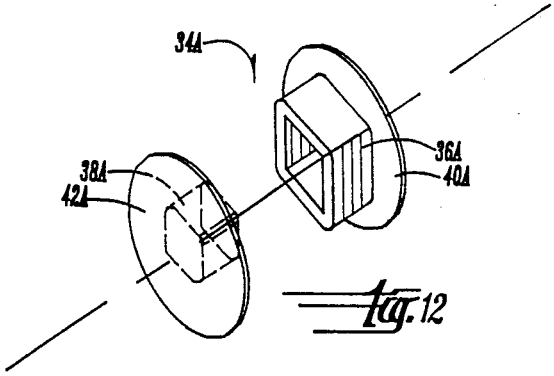
FIG. 12 is a view similar to FIG. 11 but showing an alternate embodiment of a fastener.
Figure 13:
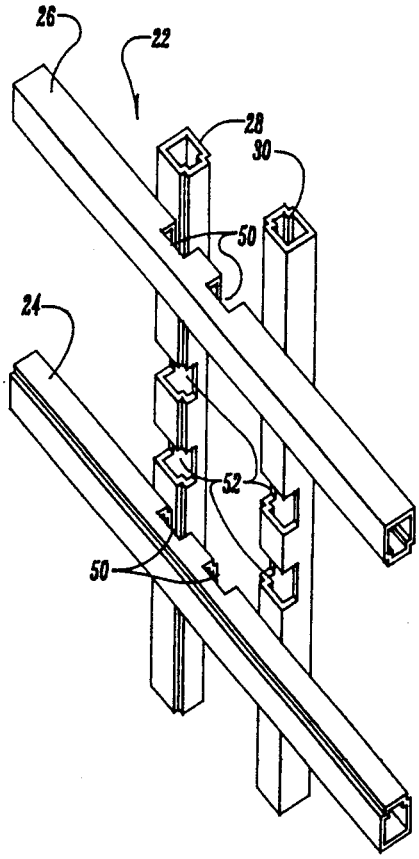
FIG. 13 is an enlarged fragmentary exploded perspective view of the component bars intersecting.

In FIG. 12, an alternate embodiment of the fastener to FIG. 11 is shown and differs by its size being larger to fill a larger opening 32 in a muntin bar grid wherein the component bars are spaced further apart. The fastener 34A also includes a rectangular in cross section telescoping element 36A which receives a mating inner telescoping component 38A. Disc heads 40A and 42A are provided.

Figure 5:
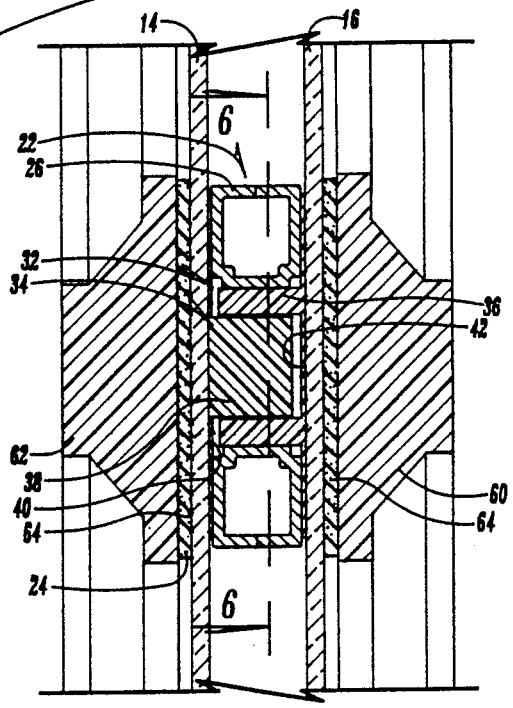
FIG. 5 is a cross sectional view taken along line 5—5 in FIG. 4.
Figure 6:
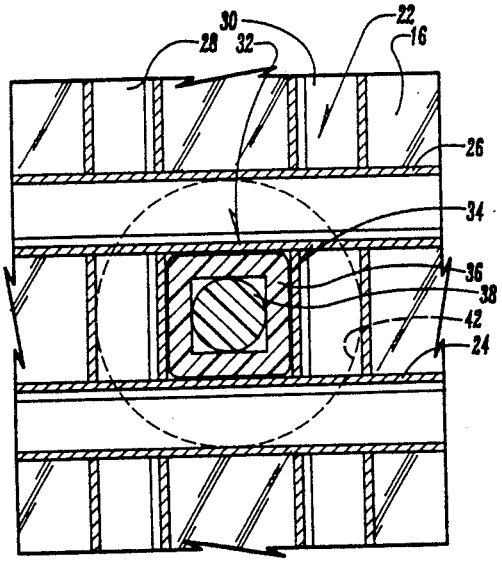
FIG. 6 is a cross sectional view taken along line 6—6 in FIG. 5.

It is seen in FIGS. 4 and 5 that external muntin bars 60 and 62 are secured by double-faced adhesive 64 to the outside faces of glass panes 16 and 14, respectively. The external muntin bars are slightly wider than the internal muntin bars as seen in FIG. 5, thus giving the true divided window appearance. It is seen that the external muntin bars 60 and 62 obscure the fact that the internal muntin bar 22 is comprised of two pairs of component bars 24, 26 and 28, 30. The pairs of component muntin bars allow for ease of varying the apparent width of the internal muntin bar and results in a savings in material cost. The component muntin bars which are integral in length between opposite sides of the perimeter bar 18 allow for a more rigid, rattle-free assembly when taken with the cooperating notches that lock the crossing component bars together. The perimeter bar 18 has the same cross sectional configuration as each of the component bars 24, 26, 28 & 30.

Figure 7:
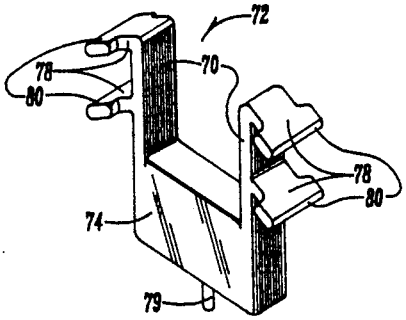
FIG. 7 is a perspective view of a U-shaped retainer used for connecting the component muntin bars to the perimeter bar.
Figure 8:
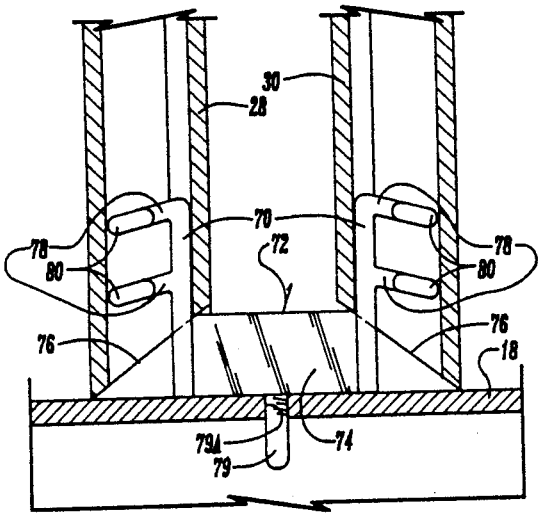
FIG. 8 is a fragmentary cross sectional view of the retainer connecting the component bars to the perimeter bar.

The component muntin bars are open-ended and receive legs 70 of a retainer 72, as seen in FIGS. 7–10. Legs 70 are interconnected by a base portion 74 which has a substantial depth extending parallel to the leg 70. In FIG. 8, the depth of the base portion 74 is accommodated by a diagonal cut 76 extending laterally inwardly a distance equal to the depth of the base portion 74. The legs 70 include outwardly and rearwardly extending arms 78 which frictionally engage the adjacent side wall of the component muntin bar to provide a tight fit and connection to the perimeter bar 18. The legs 70 frictionally engage the opposite side wall of the component muntin bar. The arms 78 are flexible so that they can yield as necessary to provide the friction fit. The outer ends 80 of the legs 78 are enlarged, as seen in FIG. 7. A locating pin 79 on the base portion 74 is received in an opening 79A in the perimeter bar 18.

Figure 9:
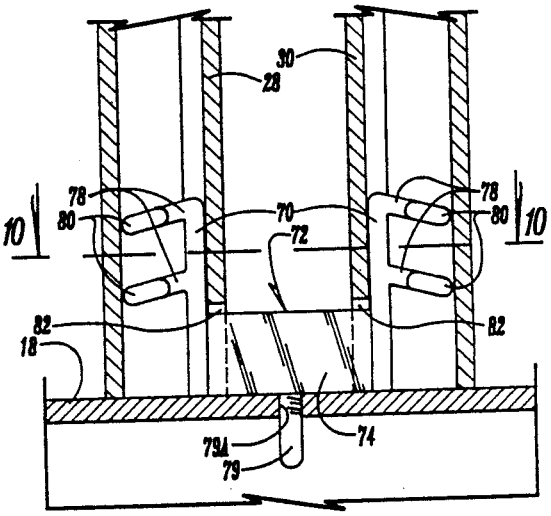
FIG. 9 is a view similar to FIG. 8, but showing a modified alternate connection.
Figure 10:
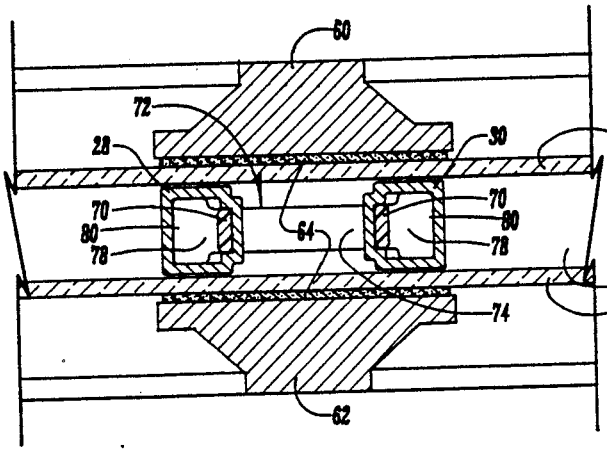
FIG. 10 is a cross sectional view taken along line 10—10 in FIG. 9.

An alternate embodiment is shown in FIG. 9 and differs only by the fact that the component bars include a slot 82 in the adjacent side walls which receives the base portion 74 of the retainer 72.

What is claimed is:

1. An insulated window assembly comprising, first and second spaced apart panes of transparent sheet material;

a perimeter bar positioned between said panes and extending around the perimeter of said panes and defining two pairs of opposite sides of said window assembly;

an internal muntin bar grid including intersecting bars having opposite ends engaging said perimeter bar; and said intersecting bars each include first and second component bars spaced apart in parallel relationship.

2. The structure of claim 1 wherein each of said component bars are one piece and extend between one of said pairs of opposite sides of said perimeter bar.

3. The structure of claim 2 wherein one of said component bars has a pair of spaced apart notches positioned to register with a corresponding pair of notches in another bar intersecting it.

4. The structure of claim 3 wherein the notches in said one bar are each facing in the same direction and the notches in the other bar are each facing in the same direction but opposite to the notches in said one bar.

5. The structure of claim 3 wherein the notches in said one bar are each facing in opposite directions and the notches in the other bar are each facing in opposite directions and in opposite directions to the corresponding registering notches in said one bar.

6. The structure of claim 1 wherein said intersecting bars form an opening between opposite first and second component bars and a fastener is positioned in said opening to lock said component bars together.

7. The structure of claim 6 wherein said opening is rectangular in shape and said fastener has a corresponding shape and size which substantially fills said opening.

8. The structure of claim 6 wherein said fastener has oppositely disposed heads positioned between said intersecting bars and said adjacent panes to space said panes form said internal muntin bar.

9. The structure of claim 8 wherein said oppositely disposed heads are disc shaped.

10. The structure of claim 9 wherein said fastener includes a pair of telescoping elements.

11. The structure of claim 10 wherein one of said telescoping elements is an outer element and is rectangular in shape and the other element is an inner element and is cylindrical in shape and is received in said outer element.

12. The structure of claim 11 wherein said outer element has an axial rectangular opening in which said inner cylindrical element is received.

13. The structure of claim 1 wherein said engagement between said component bars and said perimeter bar is further defined by said component bars being hollow and open ended and a U-shaped end retainer having legs received in the open ends of adjacent component bars.

14. The structure of claim 13 wherein said retainer has a base position interconnecting said legs and said base portion includes a locating pin means received in an opening in the adjacent perimeter bar.

15. The structure of claim 13 wherein said retainer has a base portion interconnecting said legs and said base portion has depth extending parallel to said component bars, and the open ends of adjacent component bars are tapered towards each other a distance substantially equal to the depth of said retainer base portion.

16. The structure of claim 13 wherein said retainer has a base portion interconnecting said legs and said base portion has depth extending parallel to said component bars said component bars which are adjacent have adjacent side walls which are slotted to a depth substantially equal to the depth of said retainer base portion.

17. The structure of claim 13 wherein said retainer legs have outwardly and rearwardly extending arms having outer ends in frictional engagement with an adjacent side wall of said hollow component bar to hold said component bars tight to said perimeter bar.

* * * * *